United States Patent [19]

Garman

[11] Patent Number: 4,912,067

[45] Date of Patent: Mar. 27, 1990

[54] MINERAL PAPER

[75] Inventor: Shelly N. Garman, Lancaster, Pa.

[73] Assignee: Armstrong World Industries, Inc., Lancaster, Pa.

[21] Appl. No.: 257,824

[22] Filed: Oct. 14, 1988

[51] Int. Cl.[4] ..... C03C 14/00; C04B 22/06; C04B 35/20

[52] U.S. Cl. ..... 501/32; 501/95; 501/151; 501/36; 162/152; 162/164.4; 162/181.7

[58] Field of Search ..... 501/32, 95, 151, 36; 162/152, 164.4, 181.7

[56] References Cited

U.S. PATENT DOCUMENTS

| | | | |
|---|---|---|---|
| 3,001,571 | 9/1961 | Hatch | 501/151 |
| 4,239,519 | 12/1980 | Beall et al. | 501/151 |
| 4,297,139 | 10/1981 | Beall et al. | 501/151 |
| 4,442,175 | 4/1984 | Flannery et al. | 501/12 |
| 4,569,878 | 2/1986 | Barrall et al. | 156/325 |
| 4,707,298 | 11/1987 | Tymon | 501/151 |

*Primary Examiner*—Mark L. Bell
*Assistant Examiner*—David M. Brunsman

[57] ABSTRACT

A heat and water resistant paper prepared with ceramic fiber and a 90–10 to 10–90 mixture of magnesium fluorhectorite and guanidinium fluorhectorite provides improved tensile strength. The fluorhectorites are flocculated from lithium fluorhectorite by ion exchange with 1 M solution of magnesium chloride and guanidinium chloride.

7 Claims, 1 Drawing Sheet

MINERAL PAPER

FIELD OF THE INVENTION

The invention relates to flocced mineral materials. More particularly, the invention relates to an improved tensile strength and heat resistant flocced fluorhectorite paper.

BACKGROUND OF THE INVENTION

Flocced mineral materials can be used to prepare high temperature resistant, water resistant materials. These non-asbestos materials can be prepared as described in U.S. Pat. No. 4,239,519 and No. 4,707,298. In particular U.S. Pat. No. 4,707,298 describes how lithium in lithium fluorhectorite can be exchanged with guanidinium ions to provide films with good flexibility and wet strength.

SUMMARY OF THE INVENTION

A heat and water resistant mineral article with improved tensile strength comprises magnesium fluorhectorite and guanidinium fluorhectorite.

A preferred composition comprises on a weight basis (a) 20 to 40% ceramic fiber, (b) 30 to 60% magnesium fluorhectorite, and (c) 20 to 50% guanidinium fluorhectorite to produce a paper which maintains structural integrity after heat treatment.

FIG. 1 illustrates the tensile strength improvement of the invention.

DETAILED DESCRIPTION OF THE INVENTION

Figure 1:
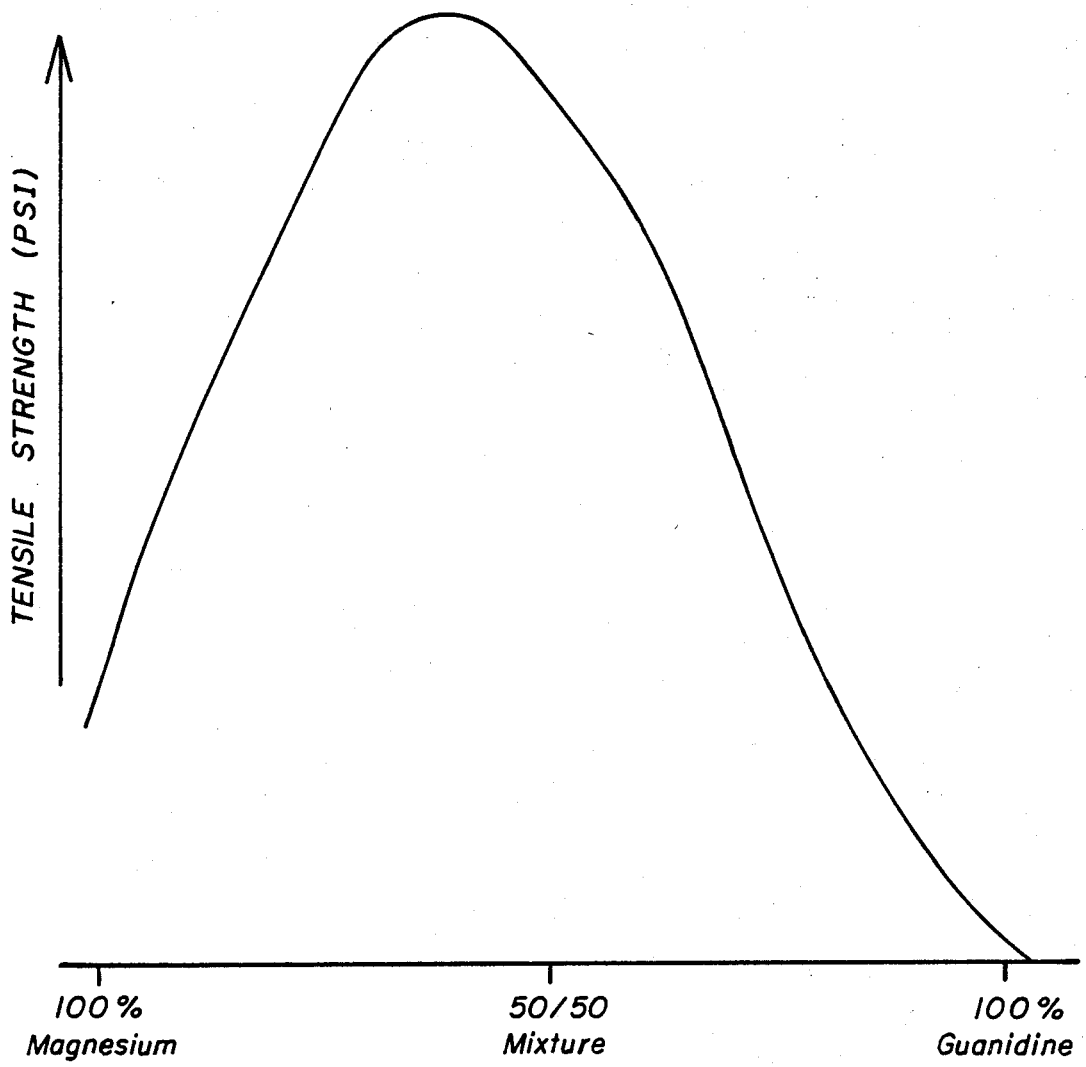

It has been discovered that mixtures of two fluorhectorite materials give surprising and unexpected properties in fluorhectorite papers. FIG. 1 provides a graphic representation of the synergism where the strength of the mixture (10–90 to 90–10) increases relative to either component alone. As shown, the tensile strength with pure magnesium fluorhectorite is slightly higher than with pure guanidinium fluorhectorite. From FIG. 1 the peak in strength occurs with a ratio of about 60% magnesium fluorhectorite to 40% guanidinium fluorhectorite.

While not known with certainty, it is believed that the very fine particle size of the guanidinium fluorhectorite floc serves to fill in voids between the larger magnesium fluorhectorite floc in the paper, thus acting as a binder.

A starting material for preparing either magnesium fluorhectorite or guanidinium fluorhectorite is lithium fluorhectorite as prepared according to U.S. Pat. No. 4,239,519. Examples 1 and 2 of U.S. Pat. No. 4,707,298 describe the preparation of guandinium fluorhectorite. Magnesium fluorhectorite is similarly prepared using $Mg^{++}$ solutions.

Reinforcing materials useful for preparing articles according to the invention are inorganic fibers such as ceramic, mineral, or glass fibers.

A preferred reinforcement material is ceramic fiber which is available as Kaowool from Babcock & Wilcox Co.

Flocculated materials were prepared and tested as described in U.S. Pat. No. 4,707,298, which is incorporated by reference.

The invention has industrial applicability for packaging materials which must retain structural integrity after elevated temperature exposure.

The following preparations and examples illustrate the practice of the invention. Example 1 represents the best mode.

PREPARATION A

Magnesium Fluorhectorite Floc

A 10% solids lithium fluorhectorite dispersion prepared according to U.S. Pat. No. 4,239,519 was added to a 1M solution of magnesium chloride under constant agitation. The salt solution represented a greater than a 4:1 weight excess to the dispersion. During the addition, the lithium dispersion was destabilized as magnesium ions exchanged with lithium ions; thereby producing flocculated magnesium fluorhectorite. The magnesium floc was washed with deionized water until chloride free. The floc (5 to 10% solids) was broken down in a Waring blender to produce a homogeneous slurry with the following particle size distribution as determined by sieve analysis.

| | 12 Mesh | 18 Mesh | 35 Mesh | 60 Mesh | 200 Mesh |
|---|---|---|---|---|---|
| % Floc Retained on Screen | 0 | 0.3% | 2.44% | 73.29% | 23.96% |

PREPARATION B

Guanidinium Fluorhectorite Floc

Guanidinium fluorhectorite floc was prepared as in Preparation A except that a 1M solution of guanidinium chloride was used for preparation of the slurry. The guanidinium fluorhectorite floc had much finer particle size than the magnesium fluorhectorite floc of Preparation A.

EXAMPLE 1

Fluorhectorite based papers were prepared containing 30% by weight Kaowool ceramic fibers. Preparation A, Preparation B, and combinations of both slurries plus the Kaowool were diluted to 2% solids with water and placed in a 11.5×11.5" hand sheet mold (manufactured by Williams Apparatus Co.) and then dewatered. The sheets produced were then wet pressed and dried on a drum drier to produce papers for testing.

Tensile strength measured were determined using an Instron at 1.5 inch jaw separation and a 0.2 inch/minute crosshead speed. Table 1 contains comparative results.

TABLE 1

| % Kaowool Fiber | % Magnesium Fluorhectorite | % Guanidinium Fluorhectorite | Tensile (PSI) |
|---|---|---|---|
| 30 | 70 | — | 391 |
| 30 | 44 | 26 | 558 |
| 30 | — | 70 | 302 |

Table 1 illustrates the discovery that papers prepared from the combination have about twice the tensile strength of control sheets.

EXAMPLE 2

Guanidinium fluorhectorite was prepared as in Preparation B except for using a vibro cell by Sonic & Materials, Inc. after the floc was blended. Median particle size was 30.7 microns with a 1 to 192 micron distribution as measured by a Cilas Granulometer. This material was used with Preparation A to prepare additional samples to allow a determination of the theoretical curve shown in FIG. 1. Table 2 contains comparative results.

TABLE 2

| % Kaowool Fiber | % Magnesium Fluorhectorite | % Guanidinium Fluorhectorite | Tensile (PSI) |
|---|---|---|---|
| 30 | 60 | 10 | 374 |
| 30 | 50 | 20 | 498 |
| 30 | 44 | 26 | 611 |
| 30 | 35 | 35 | 556 |
| 30 | 25 | 45 | 548 |
| 30 | 15 | 55 | 426 |

What is claimed is:

1. A heat and water resistant mineral article having improved tensile strength comprising about 20% to about 40% by weight fiber, about 30% to about 60% by weight magnesium fluorhectorite, and about 20% to about 50% by weight guanidinium fluorhectorite, based upon the total weight of said mineral article.

2. The article of claim 1 wherein the fiber is inorganic.

3. The article of claim 2 wherein the fiber is ceramic.

4. A heat resistant mineral paper comprising (a) about 20% to about 40% inorganic fiber, (b) about 30% to about 60% magnesium fluorhectorite, and (c) about 20% to about 50% guanidinium fluorhectorite, based upon the total weight of said mineral paper.

5. The paper of claim 4 comprising about 30% inorganic fiber.

6. The paper of claim 5 comprising 40 to 60% magnesium fluorhectorite.

7. The paper of claim 6 wherein the fiber is ceramic.

* * * * *